US008257644B2

(12) United States Patent
Shimao et al.

(10) Patent No.: US 8,257,644 B2
(45) Date of Patent: Sep. 4, 2012

(54) IRON CORE ANNEALING FURNACE

(75) Inventors: Daisuke Shimao, Tainai (JP); Koichi Katano, Tainai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 274 days.

(21) Appl. No.: 12/524,900

(22) PCT Filed: Sep. 12, 2007

(86) PCT No.: PCT/JP2007/067742

§ 371 (c)(1),
(2), (4) Date: Jul. 29, 2009

(87) PCT Pub. No.: WO2008/136142

PCT Pub. Date: Nov. 13, 2008

(65) Prior Publication Data

US 2010/0084796 A1 Apr. 8, 2010

(30) Foreign Application Priority Data

Apr. 20, 2007 (JP) ..... 2007-111195

(51) Int. Cl.
*C21D 11/00* (2006.01)
*C21D 1/74* (2006.01)

(52) U.S. Cl. ..... 266/257; 266/263

(58) Field of Classification Search ..... 266/249, 266/251, 257, 262, 263
See application file for complete search history.

(56) References Cited

U.S. PATENT DOCUMENTS 3,447,790 A * 6/1969 Ross et al. ..... 432/49
6,609,906 B1 * 8/2003 Larko ..... 432/37

FOREIGN PATENT DOCUMENTS

| | | |
|---|---|---|
| JP | 4-53927 B2 | 8/1992 |
| JP | 05-018682 | 1/1993 |
| JP | 05-106973 | 4/1993 |
| JP | 5-73500 | 10/1993 |
| JP | 06-088122 | 3/1994 |
| JP | 2558657 | 9/1997 |
| JP | 2003-113421 | 4/2003 |
| JP | 2005-326108 | 11/2005 |

OTHER PUBLICATIONS

Chinese Office Action of Appln. No. 200780050688.2 dated Jul. 19, 2010 with partial translation.

* cited by examiner

*Primary Examiner* — Scott Kastler
(74) *Attorney, Agent, or Firm* — Antonelli, Terry, Stout & Kraus, LLP.

(57) ABSTRACT

An iron core annealing furnace that is used in annealing of an amorphous iron core requiring strict control of annealing temperature. There is provided an iron core annealing furnace comprising a furnace body fitted at its superior area with a heat source and a fan, wherein the furnace body has a double layer structure consisting of a furnace interior defined by the inside division wall of the furnace body and an interspace defined by the division wall and the outside wall of the furnace body, and wherein the fan is disposed in the center of a superior area of the furnace body, and wherein the fan is adapted to introduce hot air from the furnace interior of the double layer structure, feed the hot air to the outside of the double layer structure, allow the hot air to enter the furnace interior from an inferior area of the furnace body and heat the iron core, and circulate the hot air.

10 Claims, 10 Drawing Sheets

IRON CORE ANNEALING FURNACE

INCORPORATION BY REFERENCE

The present application claims priority from Japanese Patent Application Ser. No. 2007-111195 filed on Apr. 20, 2007, the content of which is hereby incorporated by reference into this application.

TECHNICAL FIELD

The present invention relates to an annealing furnace for annealing an amorphous iron core, and in particular, to a furnace for annealing an iron core made of a material which necessitates a strict control of annealing temperature.

TECHNICAL BACKGROUND

An iron core used in a transducer is made of amorphous thin strips, having an extremely thin thickness of 0.025 mm, which are layered to have a predetermined total thickness with a large number of the layered strips up to several hundreds or more. Thus, it is hard to transmit a heat to a center zone of the amorphous core. Further, heat-treatment conditions of the amorphous iron core are strict, so that the annealing furnace necessitates a higher temperature and a temperature control. It is also necessary to run an exciting current through the center zone of the iron core during annealing. By carrying out the above-mentioned measures, predetermined properties of the amorphous iron core can be obtained. Further, for the purpose of improving the heat treatment capacity, a plurality of iron cores are arranged in predetermined numbers of rows and stages whereby simultaneously subjecting a plurality of iron cores to the annealing treatment.

A conventional annealing furnace is filled with inert gas in order to prevent the iron core from oxidizing and transmit a heat to the iron core through the inert gas. The furnace is so structured to have a heater portion, a circulation fun, and a cooling portion in the furnace. In the furnace, a temperature of the gas is controlled in the heater portion and the cooling portion, and it is circulated in the furnace by means of a circulation fan. There are two ways of gas circulation in the furnace, which are a transversely feeding way and a vertically feeding way.

Further, there are also two ways of feeding the inert gas, according to a first way of which the inert gas is continuously fed into the furnace at a predetermined rate, and a second way of which the furnace is evacuated, and subsequently the inert gas is filled in the furnace.

The temperature of the inert gas is controlled by means of a temperature control unit which is commercially available, in a temperature pattern which is classified heating, maintaining homogenous heat, and cooling.

Further, JP-A-5-18682 discloses a method adapted to aim at rectifying a hot gas so as to homogenize the distribution of temperature during circulation of the hot gas, but a temperature difference is inevitably caused among an inlet, an outlet for the hot gas, and a center position of the furnace.

DISCLOSURE OF THE INVENTION

Problems to be Solved by the Invention

There is a problem that a temperature unevenness in the furnace increases depending upon the number of products charged in the furnace and a way of arranging the products. Especially, there occurs a big temperature difference between the inlet and the outlet for the hot gas, and between an outer peripheral portion and an inner central portion of the furnace. Further, the larger the size of the furnace is increased in order to increase the throughput, the more the uniform annealing becomes difficult.

Such a problem can be solved by the present invention, and an object of the present invention is to provide an annealing furnace for annealing iron cores, such as amorphous iron cores made of materials which necessitate a strict control of annealing temperature, by uniformly heating the interior of the furnace.

Measures to Solve the Problems

In light of the object, according to a first aspect of the present invention, there is provided:

an iron core annealing furnace for annealing amorphous iron cores, which comprises a furnace body constituting an outer wall; an inner partition wall being arranged inside the outer wall; a heat source; and a fan, both the heat source and the fan being disposed in a top section of the furnace body, wherein the inner partition wall defines a furnace interior, the inner partition wall and the outer wall form a double space structure so as to define a space between the inner partition wall and the outer wall, and the fan is positioned at the center of the top section, and wherein the fan draws hot gas from the furnace interior and feeds it into the space between the inner partition wall and the outer wall so as to flow into the furnace interior through a lower section of the furnace body to heat an iron core in the furnace interior whereby circulating the hot gas.

Preferably, in the iron core annealing furnace, a plurality of the heat sources are disposed at generally even intervals at lateral positions in the top section of the furnace body around the fan.

Preferably, in the iron core annealing furnace, a perforated rectifier plate is disposed in the lower section of the furnace interior.

Preferably, in the iron core annealing furnace, louvers for introducing the hot gas into the furnace interior from a circulation passage outside of the double space structure, are disposed in the partition wall at a plurality of positions.

Preferably, in the iron core annealing furnace, there is disposed a thermocouple for measuring a temperature in the furnace interior, whereby controlling a rotating speed of the fan with use of temperature data obtainable from the thermocouple to change a flow volume of the hot gas.

Preferably, in the iron core annealing furnace, an exciting current is applicable to the iron core in order to give characteristics to the iron core and relieve stress induced therein.

Preferably, in the iron core annealing furnace, in which a plurality of iron cores are placed on an upper, a middle and a lower stages, wherein temperatures of the interiors or the outer surfaces of the iron cores are measured whereby controlling a rotating speed of the fan, or an opening and closing state of the louvers with use of the thus measured temperature data to uniformly heat the furnace interior.

According to a second aspect of the present invention, there is provided an iron core annealing furnace for annealing amorphous iron cores, wherein a furnace wall defines a furnace chamber in the furnace, and a partition wall is arranged inside the furnace wall with a distance whereby partitioning the furnace chamber into a first and a second chambers, the first chamber being formed inside the partition wall and accommodating an amorphous iron core, and the second chamber being formed between the furnace wall and the partition wall, wherein the partition wall is opened at a top section and a lower section, wherein a fan is disposed in the first chamber so as to face the opening part in the top section, wherein a heat source is disposed in the second chamber at a lateral position to the fan, and wherein hot gas is circulated between the first and the second chambers under the operation of the fan so as to be fed from the first chamber into the second chamber, and further, the hot gas is fed from the second chamber into the first chamber through an opening part in the lower section of the partition wall whereby heating the amorphous iron core accommodated in the first chamber.

Technical Effects of the Invention

According to the present invention, the furnace interior is heated uniformly, it is possible to carry out the heat treatment of a number of iron cores by a batch operation, and it is also possible to process amorphous iron cores, which have been currently used, and which should be subjected to annealing under strict heat treatment conditions.

Other objects, features and advantages of the present invention will be apparent from the following description of embodiments of the present invention with reference to the accompanying drawings.

BRIEF DESCRIPTION OF THE ACCOMPANYING DRAWINGS

BEST MODE FOR IMPLEMENTING THE PRESENT INVENTION

Herein below, with reference to the accompanying drawings, there will be provided a description of an iron core annealing furnace having a double space structure as an embodiment of the invention.

Embodiment 1

Figure 1A:
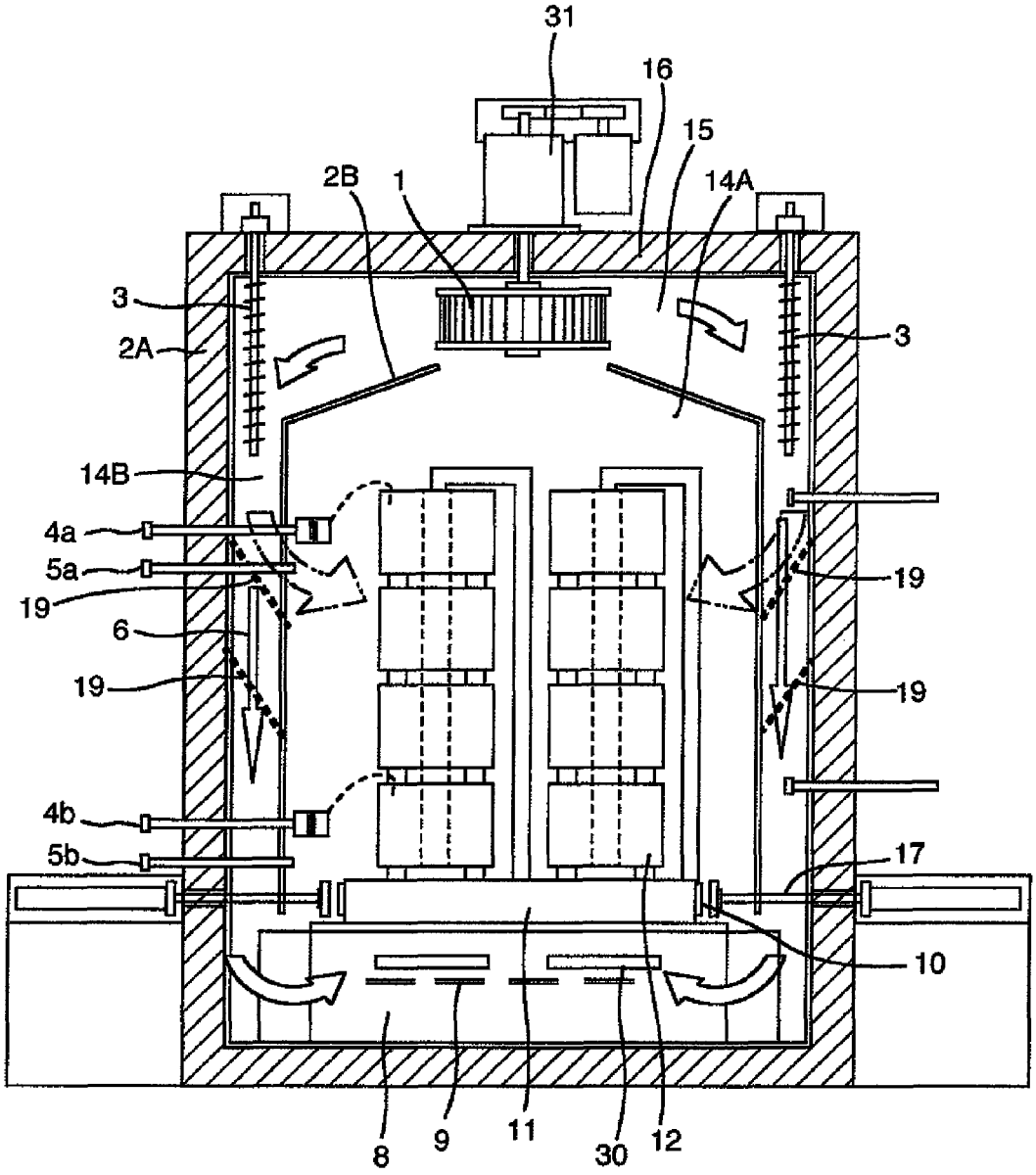
FIG. 1A is a longitudinal front sectional view illustrating a hot air circulation type annealing furnace having a double space structure according to the present invention.
Figure 1B:
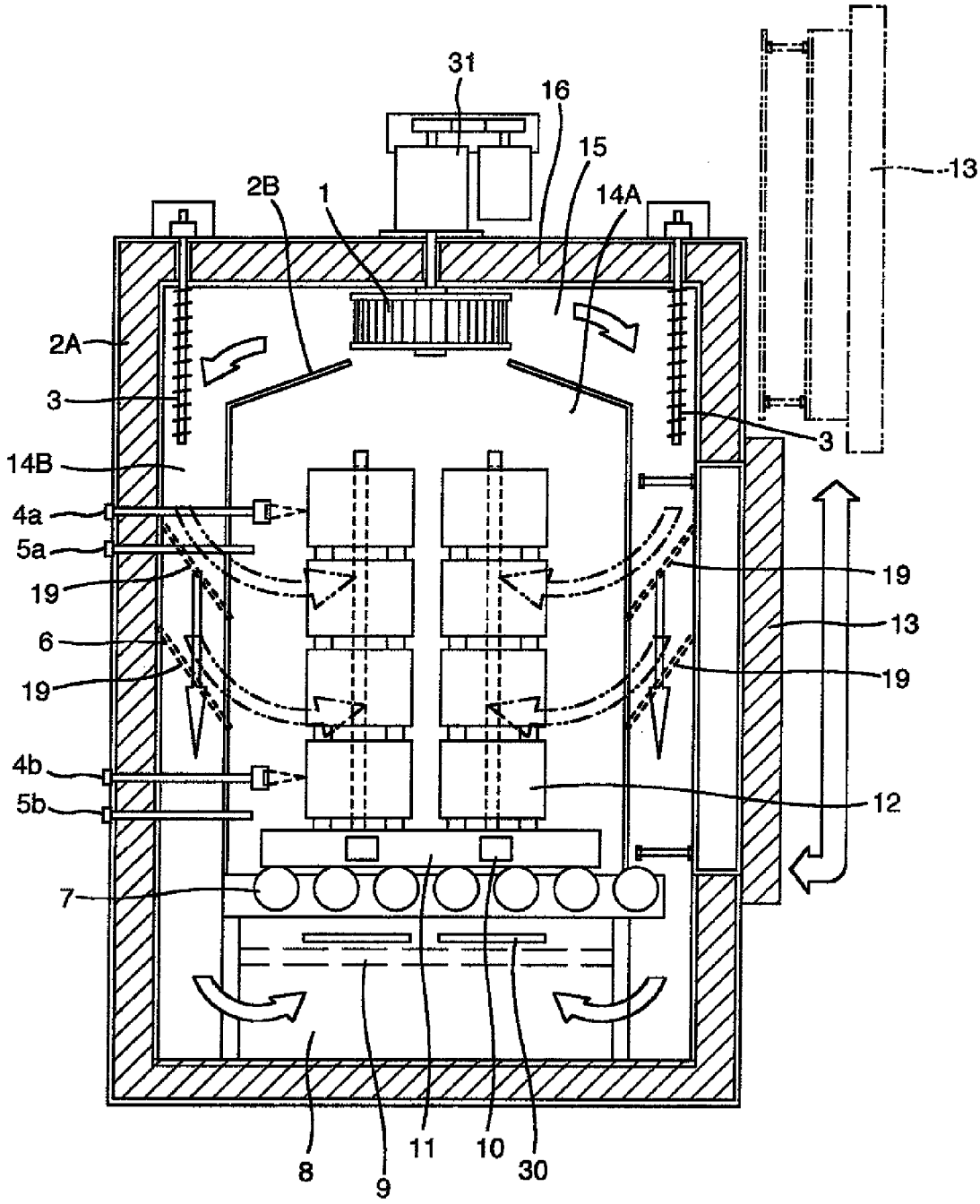
FIG. 1B is a longitudinal side sectional view illustrating a hot air circulation type annealing furnace having a double space structure according to the present invention.

FIGS. 1A and 1B are views which show a hot gas circulation type annealing furnace having a double space structure, wherein FIG. 1A is a longitudinal front sectional view, and FIG. 1B is a longitudinal side sectional view. Referring to FIGS. 1A and 1B, there are shown an outer wall (i.e. a furnace wall) 2A of the annealing furnace, and a partition wall (i.e. a muffle) or a sill 2B locating inside of the outer wall 2A. The outer wall 2A is provided with a heat-insulating material 16 so as to prevent a heat from escaping from the furnace interior (or furnace chamber) to the outside of the furnace. The outer wall 2A and the partition wall 2B define a circulation passage 14B (or a second furnace chamber) for a hot gas flow therebetween.

Referring to FIGS. 1A and 1B, there is shown a circulation fan 1 such as a sirocco fan, which sucks thereinto heated air around the axis of the fan and blows out the heated air in the direction of rotation of the fan. While there is formed a passage for the hot air at the center of the partition wall in the top section of the furnace interior, the fan 1 is so disposed that the fan axis is in alignment with the center passage, and the rotating direction of the fan 1 faces the circulation passage in the top section of the furnace interior. The circulation fan 1 is driven by a motor 31 being mounted on the outer wall in the top of the furnace. It is noted that the rotating speed of the motor 31 may be controlled by means of an inverter which is though not shown, in order to control an air flow. The hot air (air or inert gas) blown out from the circulation fan 1 is heated up by means of heaters 3 disposed at upper corners of the circulation passage, is thereafter fed downward, and finally flows into the furnace interior from the lower part of the circulation passage.

The heaters 3 is of an electric type, such as a halogen heater or a radiant tube heater. The hot air heated by means of the heaters 3 is fed downward in the circulation passage to flow into the furnace interior from the bottom portion of the circulation passage, and to flow upwards from the bottom portion 8 of the furnace interior, whereafter the hot air flows into the furnace interior 14A (or first furnace chamber), in which iron cores as objects to be annealed are positioned, through a rectifier plate 9 provided in the lower part of the furnace interior. Further, the hot gas in the furnace interior 14A, is sucked into the circulation fan 1 provided in the top section of the furnace interior, and is then blown into the circulation passage along the rotating direction of the circulation fan 1, for circulation.

Shield plates 30 may be arranged above the rectifier plate 9 so as not to make the hot air to blow against the iron cores to be annealed, which iron cores are located at a lower stage, whereby making an unevenness of heating temperature small among the iron cores stacked up in the furnace interior. This fact was experimentally confirmed.

Further, thermocouples 5*a*, 5*b* for measuring temperatures in the furnace interior 14A are disposed through the outer wall in order to measure temperatures at two places in the upper and lower zones of the furnace interior. If the temperature in the upper zone of the furnace interior is high, the air volume 6 in the circulation passage is increased, but if the temperature in the lower zone of the furnace interior is high, the air volume 6 is decreased in order to control the temperature of the furnace interior so as to aim at obtaining a uniform temperature distribution in the furnace interior.

Upper and lower thermometers 4*a*, 4*b* are disposed in the furnace in order to measure temperatures of the objects 12 to be annealed in order to control the temperature, depending upon conditions of temperature rise of the objects 12 to be annealed.

Further, there are disposed louvers 19 in the partition wall 2B on the furnace interior side, below the heaters 3, so as to be arranged in order to feed the hot gas from the circulation passage into the furnace interior 14A around the middle stage of the furnace. The louvers 19 are arranged vertically at multi-stages by a plural number in the circumferential direction of the furnace, being capable of opening and closing and being angularly adjusted. Thus, the direction of the hot gas can be controlled, thereby it is possible to blow the hot gas, being directed not only vertically but also laterally directly to the iron cores to be annealed, and as well, the hot gas can be fed through gaps among the iron cores which are stacked up.

The introduction of the iron cores to be annealed into and out from the annealing furnace can be made by opening a door 13 with the use of a tray 11 on which the iron cores are loaded and which is carried on rollers 7.

Further, the control for the operation of the louvers 19 can be made manually or automatically in the way that the louvers are operated while the temperature of the furnace interior and the temperature of the objects 12 to be annealed are monitored, thereby it is possible to aim at making the annealing uniform.

Further, there is provided a space in the furnace bottom portion 8, for allowing the hot gas to remain therein so as that the hot air which has passed through the side zones 15 of the furnace and the hot gas which has passed through the circulation passage 14B are mixed with each other in order to aim at uniformly heating the objects to be annealed, irrespective of the capacities of the respective heaters 3. Further, there is arranged the rectifier plate 9 by means of which the heat can be uniformly distributed in the furnace interior 14A when the hot gas flows from the furnace bottom portion 8 into the furnace interior 14A.

Further, a cooling unit which is though not shown, is attached to the annealing device and is adapted to be operated when cooling is required. The cooling unit has a pipeline which passes through the circulation passage or the furnace interior, and through which water flows for cooling, as to a coolant therefor, there may be used a liquid coolant, air or the like other than the water.

Inert gas is used for the annealing atmosphere, but the annealing can be made without using the inert gas. However, the inert gas is used for an amorphous material since this is adversely affected by occurrence of rust during annealing. There can be exemplified two types of ways for setting the inert gas atmosphere in the furnace interior, one of which continuously introduces the inert gas into the furnace interior, and the other one of which introduces the inert gas into the furnace interior after the furnace interior is vacuum-evacuated. The atmosphere in the furnace interior is monitored by an inert gas meter or an oxygen density meter so as to adjust the flow rate of the inert gas.

Figure 2:
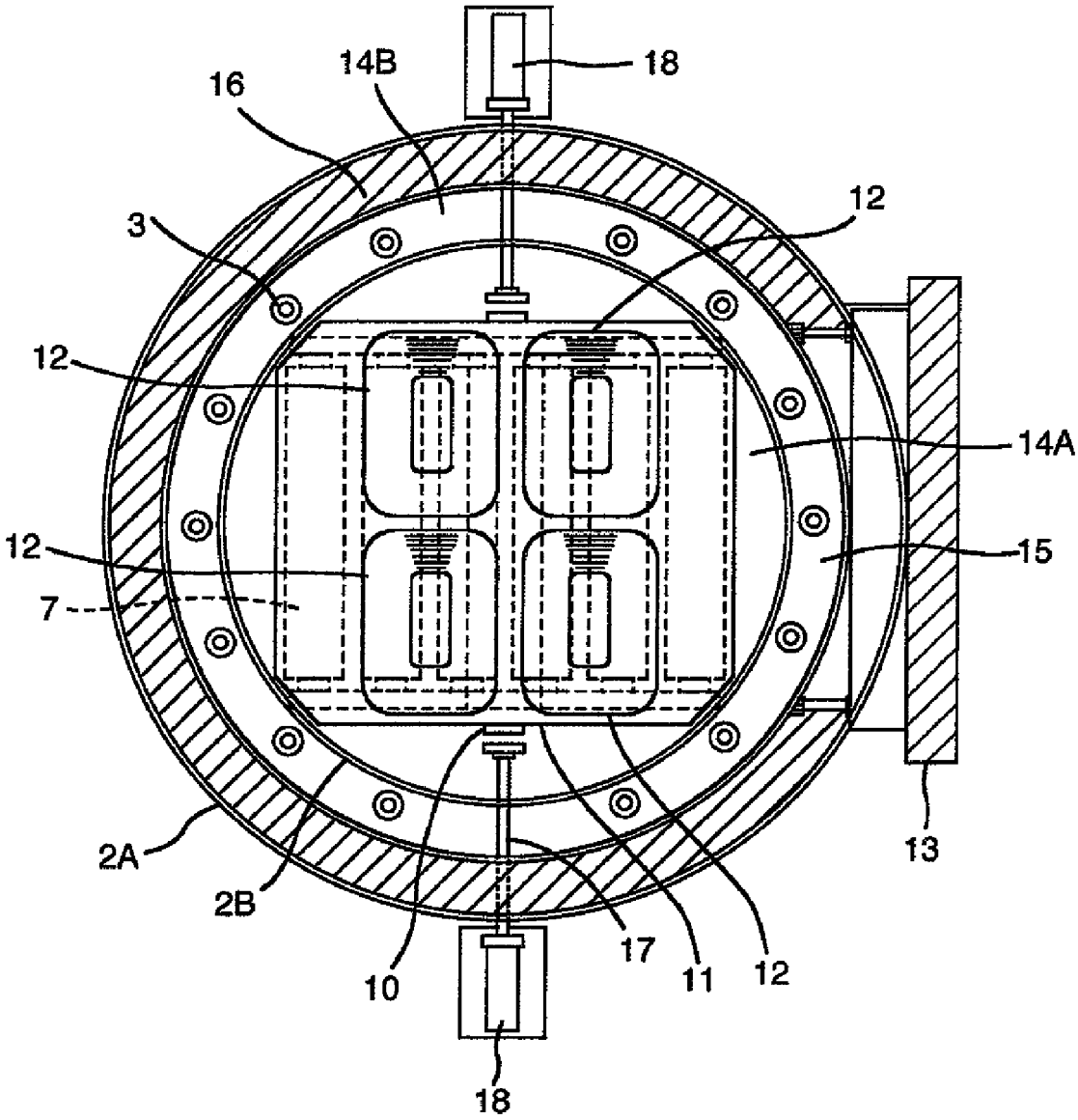
FIG. 2 is a cross-sectional view illustrating the hot air circulation type annealing furnace shown in FIG. 1 and having a circular cross-sectional shape.

FIG. 2 is a transverse plan view which shows a hot gas circulation type annealing furnace having a double space structure having a cylindrical external shape, this annealing furnace is incorporated therein with heaters 3 which are located in the upper part of a circulation passage 14B defined between an outer wall having a heat insulating material 16 and a partition wall 2B, and which are circumferentially at equal intervals. With the heaters 3 arranged at equal intervals, it is possible to aim at uniformly distributing the temperature in the furnace interior.

The number of heaters may be set to any value which is larger or smaller that that shown in FIG. 2, the larger the number of the heaters 3, the higher the response speed with respect to the temperature pattern.

Further, as shown in FIG. 2, an exciting current is applied to the amorphous iron cores for annealing thereof, and accordingly, after setting a tray 11 in the furnace interior, an electrode contact portion of the tray 10 is made into contact with an electrode 17 by means of an electrode pressing cylinder 18 in order to anneal the amorphous iron cores while the iron core is magnetically excited.

Figure 3:
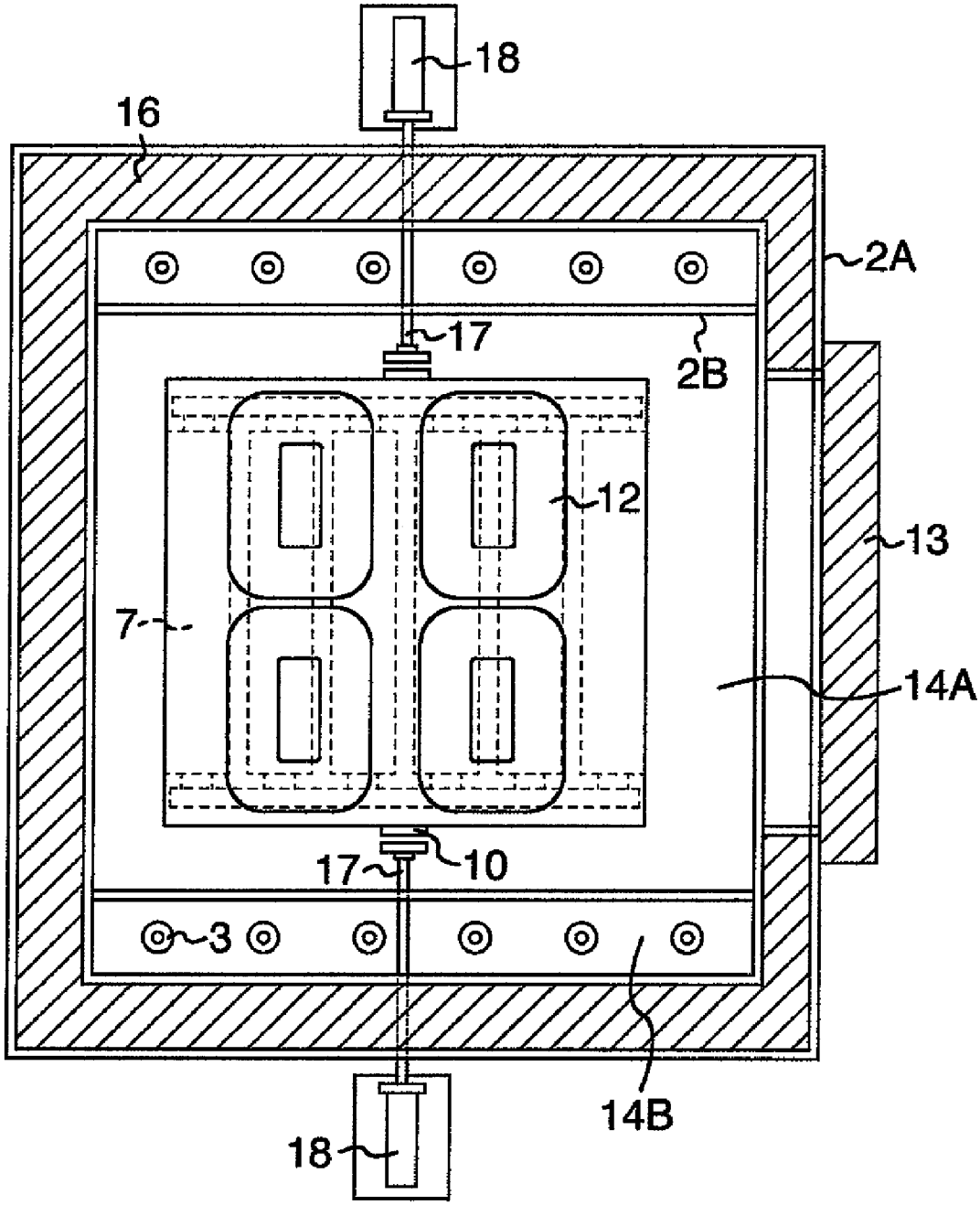
FIG. 3 is a cross-sectional view illustrating a hot air gas circulation type annealing furnace in another embodiment of the present invention having a quadrate cross-sectional shape.

FIG. 3 shows another embodiment of the present invention in which the annealing furnace has a parallelepiped external shape.

In the case of the annealing furnace shown in FIG. 3, the heaters 3 are arranged at equal intervals from side to side as viewed from the door 13. In the case of the parallelepiped shape annealing furnace, a wide space can be ensured in the furnace interior, and accordingly, a larger number of iron cores to be annealed can be accommodated in the annealing furnace, thereby it is possible to enhance the annealing efficiency. Although the heaters 3 are arranged at equal intervals from side to side, as viewed from the door 13 in the case of the annealing furnace shown in FIG. 3, there may be arranged heaters at equal intervals on the backside (left side in the drawing) of the heaters 3.

Next, referring to FIG. 4, an explanation will be made of the rectifier plate 9 provided in the furnace interior.

Figure 4A:
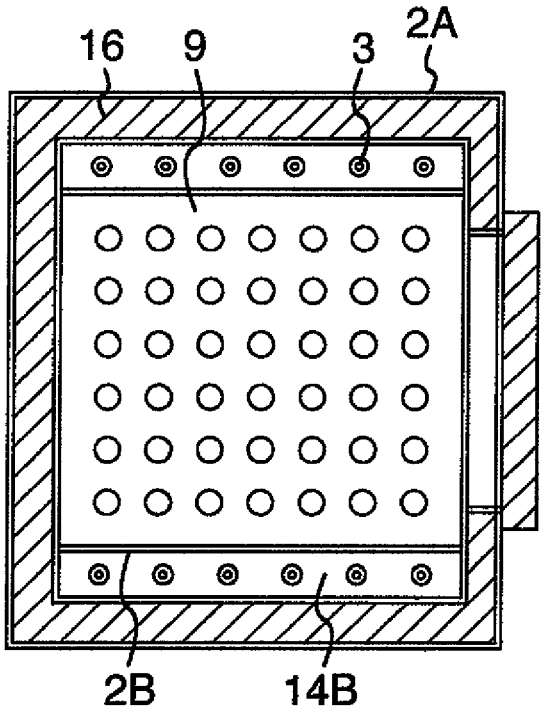
FIG. 4A is a view illustrating a rectifier plate provided in a furnace interior of a hot air circulation type annealing furnace according to the present invention, which has a parallelepiped shape in its entirety.

FIG. 4 shows the rectifier plate 9 provided on the lower side of the furnace interior in the case where the hot gas circulation type annealing furnace having a double space structure has a parallelepiped shape, the rectifier plate 9 is formed therein with holes at equal intervals, length and width thereof.

Further, the rectifier plate 9 is removable, that is, the rectifier plate 9 can be replaced with another one selected from those having different diameter holes, which have been beforehand prepared, in accordance with an annealing condition.

Figure 4B:
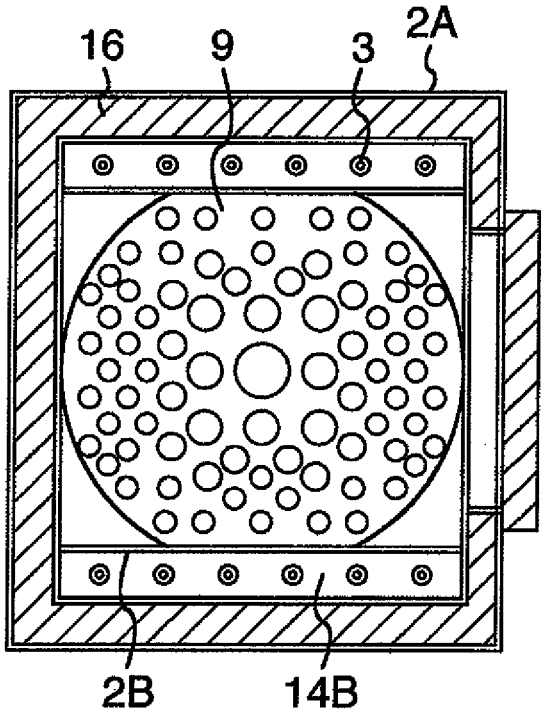
FIG. 4B is a view illustrating a rectifier plate having holes with different diameters, in a hot gas circulation type annealing furnace having a double space structure according to the present invention.

Referring to FIG. 4B, there is shown a rectifier plate 9 formed therein with holes having different diameters. In the hot gas circulation type annealing furnace having a double space structure, according to the present invention, the diameters of the holes are successively decreased toward the peripheral portion of the furnace from the center thereof where the diameters of the holes are large since the iron cores are set in the center portion of the furnace interior. With the configuration that the diameters of the holes are successively changed, the iron cores can be heated in a more uniform manner.

It is noted here that there are no holes at the four corners of the rectifier plate 9 shown in FIG. 4B.

Figure 4C:
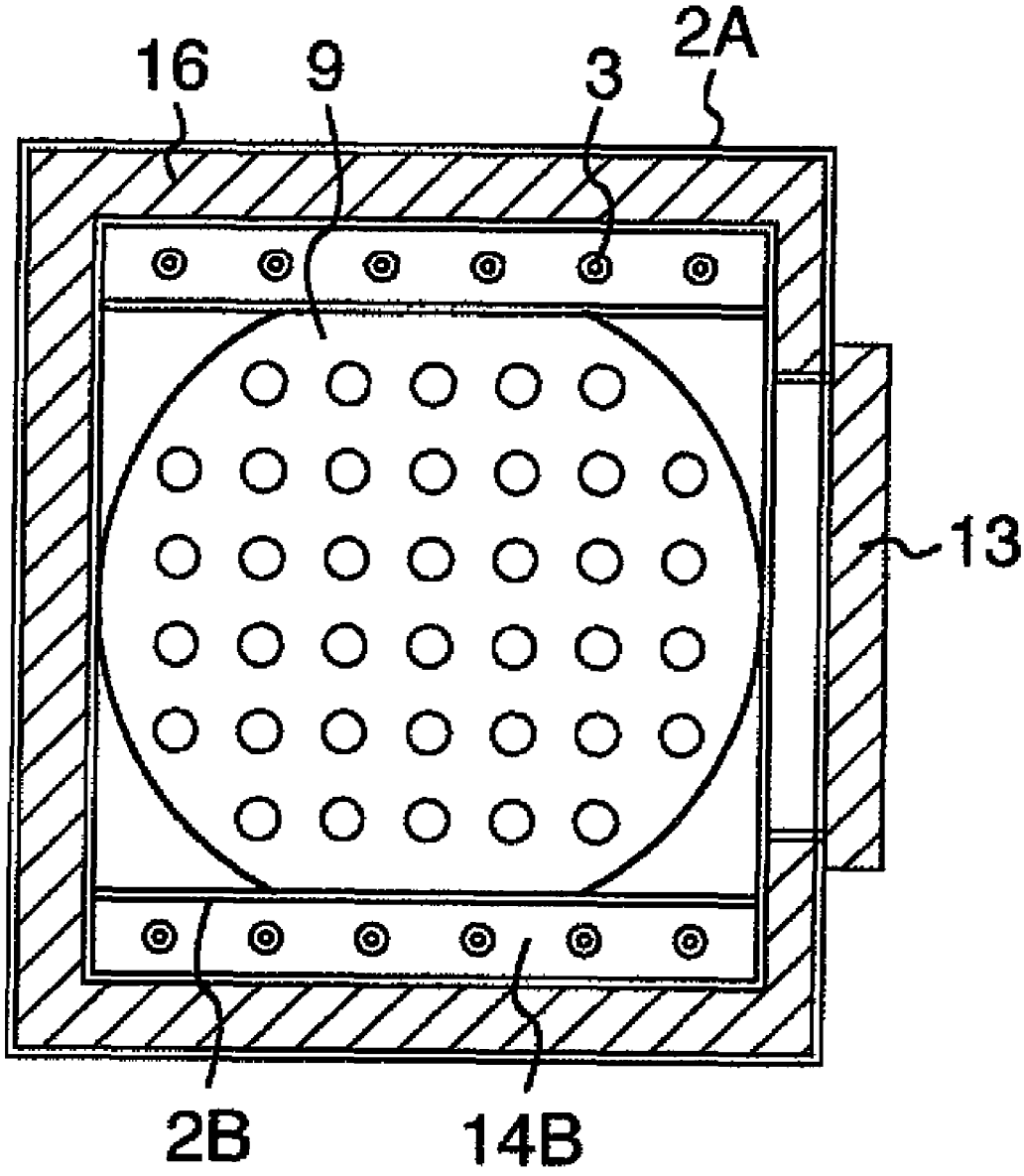
FIG. 4C is a view illustrating a rectifier plate in a hot air circulation type annealing furnace having a double space structure according to the present invention, the rectifier plate being formed therein with holes at equal intervals, length and with, the holes being arranged not over the entire area of the rectifier plate, but within a circular zone.

FIG. 4C shows a rectifier plate 9 having the holes which are arranged at equal intervals, length and width thereof, within a circular zone, rather than over the entire area of the rectifier plate 9. There are formed no holes at the four corners of the rectifier plate 9, similar to that shown in FIG. 4B.

Further, as stated above, the shield plate 30 is disposed above the rectifier plate in order to prevent the hot gas from directly impinging onto the iron cores set in the lower stage of the furnace inside, and accordingly, only the temperature of the iron cores at the lower stage is prevented from being raised.

In this configuration of this embodiment, the mounting positions of the circulation fan, the heaters and the rectifier plate can vertically reversed without hindrance to the operation thereof.

Figure 5:
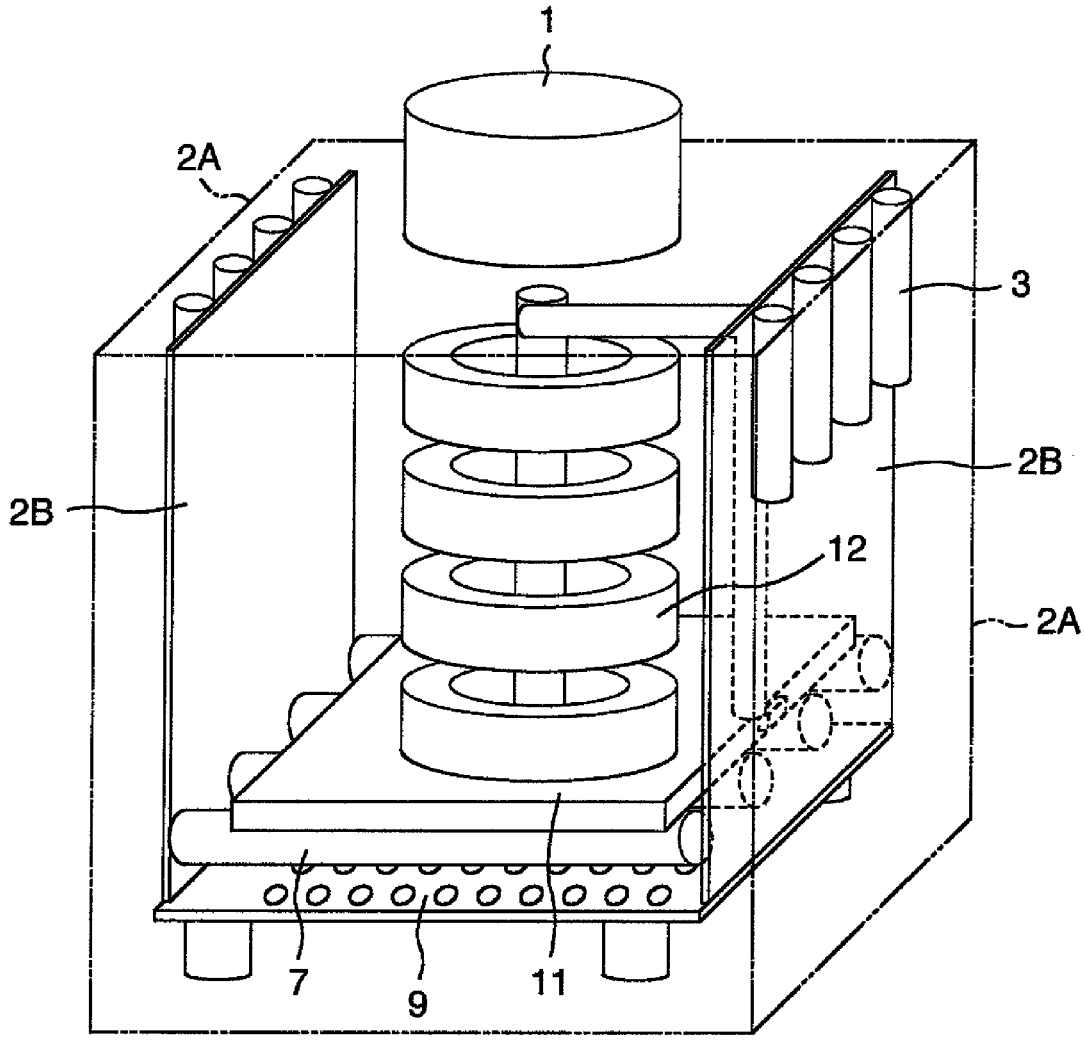
FIG. 5 is a perspective view illustrating a hot air circulation type annealing furnace according to the present invention.

FIG. 5 is a perspective view which schematically shows the hot gas circulation type annealing furnace having a double space structure shown in FIG. 1. Referring to FIG. 5, there are shown the iron cores 12 which are stacked at four stages.

Figure 6:
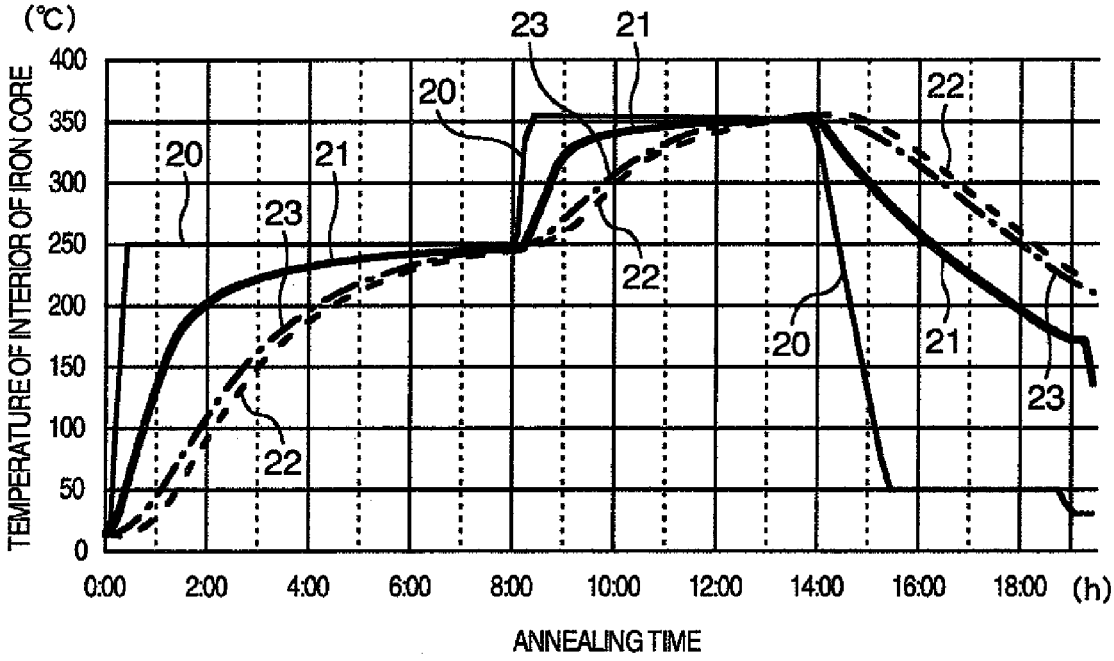
FIG. 6 is a view illustrating a temperature pattern in a hot air gas circulation type annealing surface according to the present invention, in the case where an iron core itself is annealed at two stages (the abscissa exhibits annealing time, and the ordinate exhibits temperature.

FIG. 6 shows a temperature pattern in the hot gas circulation type annealing furnace having a double space structure, according to the present invention, in the case of annealing the iron cores themselves at two stages. In FIG. 6, a time is taken on the abscissa and a temperature is taken on the ordinate.

Referring to FIG. 6, there are shown a temperature pattern 20 with a set annealing condition, a surface temperature 21 of a side surface of an iron core, a temperature 22 of the inside of the iron core, and a temperature 23 of a lamination thicknesswise end part of the iron core.

The two stage annealing process includes a first step of setting the temperature of the inside of the iron core to 250 deg.C., and a second step of, after a given time elapses, increasing the temperature thereof up to 350° C. in order to anneal the iron cores. The temperatures at the first and second steps are changed depending upon the annealing condition. In the case of the iron core shown in FIG. 5, if the set temperature is 250° C., the temperature 21 of the surface temperature 21 of the iron core, the temperature 22 of the inside thereof and the temperature 23 of the lamination thicknesswise end part of thereof core come up to 250° C. after about 8 hours lapses, and at this time, if the temperature is set to 350° C., the temperatures of these parts come up to 350° C. after 3 hours elapses (refer to FIG. 7). Further, there is also shown the temperature pattern at the time when the heating is stopped after 14 hours elapses.

As understood from FIG. 6, no temperature differences can be found among the iron cores stacked one upon another in the case of the two stage annealing in the hot gas circulation type annealing furnace having a double space structure according to the present invention, that is, they are uniformly heated and annealed.

Thus, the hot gas circulation type annealing furnace according to the present invention can exhibit the advantage that the furnace interior can be uniformly heated.

Figure 8:
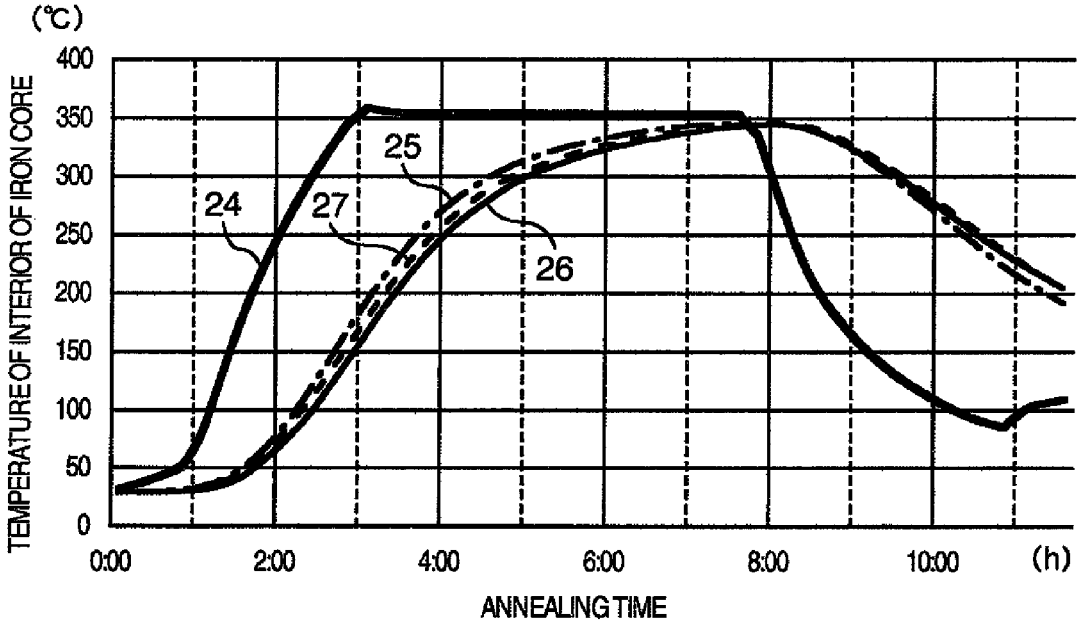
FIG. 8 is a graph illustrating a temperature distribution in iron cores which are vertically stacked in an annealing furnace according to the present invention.

FIG. 8 shows a temperature pattern that is obtained in the annealing furnace according to the present invention, in which sixteen iron cores are set, in the case of a single stage annealing.

In the case of the single stage annealing, the temperature of the inside of the iron core is set to 350° C. as shown in FIG. 8, and the iron cores are heated. There can be found from FIG. 8 as follows: after about 10 hours elapses, the temperature 25 of the insides of the iron cores at the lower stage comes up to 350° C., and the temperature 26 of the insides of the iron cores at the upper stage and the temperature 27 of the insides of the iron cores at the middle stage are both also come up to 350° C. Further, FIG. 8 also shows therein the atmospheric temperature 24.

Further, the temperature shown in FIG. 8, no remarkable temperature difference is found among the iron cores set all upper, middle and lower stages, that is, it is found that they are uniformly heated and annealed. The iron cores set at the middle stage correspond to two iron cores arranged at the middle of the iron cores shown in FIG. 5. It is noted that the temperature 27 of the insides of the iron cores set at the middle stage, is an averaged temperature between the temperatures of the insides of two iron cores.

Figure 9:
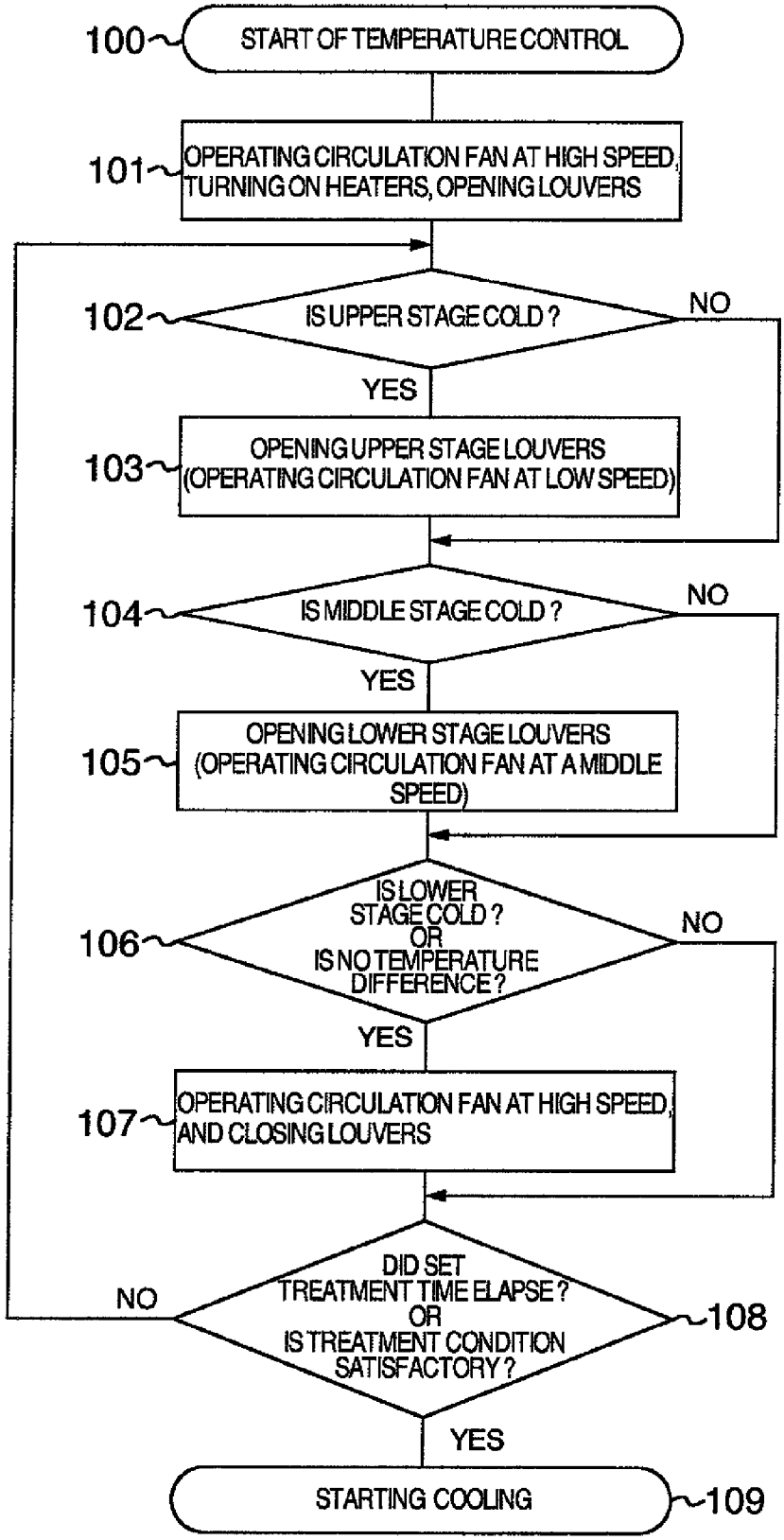
FIG. 9 is a flow-chart for explaining a heat control in a furnace according to the present invention.

Further, this temperature pattern can be obtained under heating control as shown in FIG. 9.

Next, explanation will be made of an annealing heat-treatment method with reference to FIG. 9.

Usually, the temperature control is carried out with a temperature and a time which are set by a program controller. However, the temperature of the inside of the iron core is different depending upon a season or a time of the introduction into a furnace, by about 20° C. at maximum, and accordingly, the heat-treatment condition should have been changed. Thus, a thermocouple is set in the iron core which is the object 12 to be annealed, in order to measure the heat value of the object 12 to be annealed. Thus, it is possible to complete the annealing at the time when a predetermined treatment condition is satisfied in addition to the control with a usual pattern.

Further, in order to making a temperature even in the furnace interior, the air volume and the air flowing direction can be controlled.

For example, the air is usually blown, upward from the lower side of the furnace interior. Thus, the heat conduction is highest for the iron cores which are set at the lower stage where the gas flows by a largest volume, and which are therefore annealed at a first time, but the temperature of the insides of the iron cores set at the upper stage cannot be smoothly increased since the hot air cannot be sufficiently blown onto them. In order to reduce the annealing speed difference therebetween, the temperatures of the insides of the iron cores at both upper and lower stages, and as well the temperature of the atmosphere in the furnace interior are measured, and accordingly, if a temperature difference occurs between the upper and lower stages, the louvers are opened so as to introduce the hot air into the furnace interior from the middle stage thereof in order to blow the hot air onto the iron cores positioned at the upper stage. Thereby it is possible to allow the temperature differences among the upper, middle and lower stages to be less.

A plurality of connectors for thermocouples removably positioned in the furnace interior are provided for the purpose of controlling and measuring, so that it is possible to increase the number of points to be controlled and points to be measured, and to relocate such points.

If the iron cores positioned at the upper stage are cold, it is possible to open the louvers, and to lower the air speed whereby leading radiation heat from the heaters to the iron cores and shortening a circulation length for the hot air so that the heat is transmitted at a maximum to the upper stage.

If the iron cores positioned at the middle stage are cold, the louvers are opened, and the air speed is increased so that the hot air is directed at a maximum to the iron cores at the middle stage, whereby enabling a rising rate of temperature of the iron cores at the middle stage to increase.

If the iron cores at the lower stage is cold, the louvers are closed, and the air speed is increased so that the hot air is directed at a maximum to the iron cores at the lower stage, whereby enabling a rising rate of temperature of the iron cores at the lower stage.

FIG. 9 shows a flow-chart for explaining the heat-treatment of the annealing furnace according to the present invention.

Referring to FIG. 9, when the temperature control is started (Step 100), the furnace is operated under the condition that the circulation fan is driven to rotate at a high speed while the heaters are turned on, and the louvers are closed, whereby the iron cores are heated (Step 101) (a normal operation). Next, the temperature of the iron cores positioned at the upper stage is checked (step 102). If the temperature is lower than a set temperature, the louvers at the upper stage is opened, and the circulation fan is rotated at a low speed (Step 103). If the temperature of the iron cores positioned at the upper stage is higher than the set temperature, the iron cores positioned at the middle stage is checked under the normal operating condition (Step 104).

If the temperature of the iron cores positioned at the middle stage is lower than the set temperature, the louvers at lower stage is opened while the circulation fan is changed over into a middle speed operation (Step 105). If the temperature of the iron cores positioned at the middle stage is higher than the set temperature, the temperature of the iron cores positioned at the lower stage is checked in the normal operating condition (Step 106).

If the temperature of the iron cores positioned at the lower stage is lower than the set temperature, or if the temperature difference between the temperature of the iron cores positioned at the upper stage (or the middle stage) and the temperature of the iron cores positioned at the lower stage is smaller than a predetermined value, the circulation fan is rotated at a high speed while the louvers are closed (Step 107). If the temperature of the iron cores positioned at the lower stage is higher than the set time, or the temperature difference between the iron cores positioned at the upper stage (or the middle stage) and the temperature of the iron cores positioned at the lower stage is larger than the predetermined value, a time for the annealing is checked, or a treatment condition is checked (Step 108). If the annealing has been completed, the cooling unit is operated to start the cooling (Step 109). If the annealing has been not yet completed, the normal operation is continued, the temperature of the iron cores positioned at the upper stage is checked (Step 102). Then, the above-mentioned heat-treatment steps are repeated.

Figure 7:
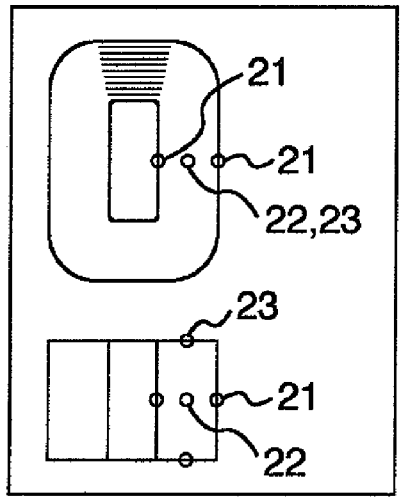
FIG. 7 is a view illustrating positions on an iron core, at which the temperatures are measured corresponding to numbers (21 to 23) in the graph shown in FIG. 6.

Thus, when the heat-treatment control shown in FIG. 9 is carried out, the unevenness among the temperatures of the iron cores respectively positioned at the upper stage, middle and lower stages becomes very smaller as shown in FIG. 7, whereby it is possible to carry out satisfactory annealing.

Further, referring to FIG. 9, the temperatures of the iron cores positioned at the upper, middle and lower stages are measured, and the thus measured temperatures are utilized in order to control the heating of the furnace interior. However, the temperature of the outer surfaces of the iron cores may be measured for the temperature data, or the temperature around the iron cores may be also used.

INDUSTRIAL APPLICABILITY

According to the present invention, a lot of objects to be annealed, such as amorphous iron cores which require strict heat-treatment conditions, can be annealed at a time.

It will be further understood by those skilled in the art that the foregoing description has been made on embodiments of the invention and that various changes and modifications may be made in the invention without departing from the spirit of the invention and scope the appended claims.

EXPLANATION OF REFERENCE NUMERALS IN THE DRAWINGS

1 a fan
2A an outer wall
2B a partition wall
3 heaters
4 radiation thermometers
5*a*, 5*b* thermocouples
6 an air volume
7 rollers
8 a bottom portion
9 a rectifier plate
10 an electrode contact portion of the tray
11 a tray
12 objects to be annealed (i.e. iron cores)
13 a door
14A a furnace interior (a first furnace chamber)
14B a circulation passage (a second furnace chamber)
15 side zones
16 a heat-insulating material
17 an electrode
18 an electrode pressing cylinder
19 louvers
20 a temperature pattern
21 a surface temperature
22 a temperature of the inside of the iron core
23 a temperature of a lamination thicknesswise end part of the iron core
25 a temperature of the insides of the iron cores on the lower stage
26 a temperature of the insides of the iron cores on the upper stage
27 a temperature of the insides of the iron cores at the middle stage
30 shield plates
31 a motor

The invention claimed is:

1. An iron core annealing furnace for annealing amorphous iron cores, which comprises a furnace body constituting an outer wall; an inner partition wall being arranged inside the outer wall; louvers disposed in the partition wall at a plurality of positions; a heat source; and a fan, both the heat source and the fan being disposed in a top section of the furnace body, wherein the inner partition wall defines a furnace interior, the inner partition wall and the outer wall form a double space structure so as to define a space between the inner partition wall and the outer wall, and the fan is positioned at the center of the top section, and wherein the fan draws hot gas from the furnace interior and feeds it into the space between the inner partition wall and the outer wall so as to flow into the furnace interior through a lower section of the furnace body and so as to be able to flow into the furnace interior through the louvers to heat an iron core in the furnace interior thereby circulating the hot gas.

2. An iron core annealing furnace according to claim 1, wherein a plurality of the heat sources are disposed at generally even intervals at lateral positions in the top section of the furnace body around the fan.

3. An iron core annealing furnace according to claim 1, wherein a perforated rectifier plate is disposed in the lower section of the furnace interior.

4. An iron core annealing furnace according to claim 1, wherein a shield plate is disposed above a rectifier plate disposed in the lower section of the furnace interior.

5. An iron core annealing furnace according to claim 1, wherein there is disposed a thermocouple for measuring a temperature in the furnace interior, whereby controlling a rotating speed of the fan with use of temperature data obtainable from the thermocouple to change a flow volume of the hot gas.

6. An iron core annealing furnace according to claim 1, further comprising means for applying an exciting current to the iron core in order to give characteristics to the iron core and relieve stress induced therein.

7. An iron core annealing furnace according to claim 1, in which a plurality of iron cores are placed on an upper, a middle and a lower stages, and the iron core annealing furnace further comprises a plurality of temperature measuring devices for measuring temperatures of the furnace interior or the outer surfaces of the iron cores, wherein temperatures of the furnace interior or the outer surfaces of the iron cores are measured whereby controlling a rotating speed of the fan, or an opening and closing state of the louvers with use of the thus measured temperature data to uniformly heat the furnace interior.

8. An iron core annealing furnace for annealing amorphous iron cores, wherein a furnace wall defines a furnace chamber in the furnace, and a partition wall is arranged inside the furnace wall with a distance thereby partitioning the furnace chamber into a first and a second chambers, the first chamber being formed inside the partition wall and accommodating an amorphous iron core, and the second chamber being formed between the furnace wall and the partition wall, wherein the partition wall is opened at a top section and a lower section, and louvers are disposed in the partition wall at a plurality of positions, wherein a fan is disposed in the first chamber so as to face the opening part in the top section, wherein a heat source is disposed in the second chamber at a lateral position to the fan, and wherein hot gas is circulated between the first and the second chambers under the operation of the fan so as to be fed from the first chamber into the second chamber, and further, the hot gas is fed from the second chamber into the first chamber through an opening part in the lower section of the partition wall and can be fed into the furnace interior through the louvers thereby heating the amorphous iron core accommodated in the first chamber.

9. An iron core annealing furnace according to claim 8, wherein the louvers are configured to be capable of opening and closing and being angularly adjusted.

10. An iron core annealing furnace according to claim 1, wherein the louvers are configured to be capable of opening and closing and being angularly adjusted.

* * * * *